US006546862B1

(12) United States Patent
Jentzsch

(10) Patent No.: US 6,546,862 B1
(45) Date of Patent: Apr. 15, 2003

(54) METHOD AND DEVICE FOR PRODUCING A MULTICOLOR PRINT

(75) Inventor: Arndt Jentzsch, Coswig (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/763,613

(22) PCT Filed: Aug. 12, 1999

(86) PCT No.: PCT/DE99/02556

§ 371 (c)(1),
(2), (4) Date: Mar. 2, 2001

(87) PCT Pub. No.: WO00/13903

PCT Pub. Date: Mar. 16, 2000

(30) Foreign Application Priority Data

Sep. 2, 1998 (DE) ..... 198 39 875

(51) Int. Cl.[7] ..... B41M 1/14

(52) U.S. Cl. ..... 101/211; 101/171; 101/177; 101/232

(58) Field of Search ..... 101/211, 171, 101/177, 175, 232, 217, 183

(56) References Cited

U.S. PATENT DOCUMENTS

| | | | | | |
|---|---|---|---|---|---|
| 1,085,224 | A | * | 1/1914 | Roesen | 101/211 |
| 4,011,812 | A | | 3/1977 | Lecha | |
| 4,509,424 | A | * | 4/1985 | Germann | 101/177 |
| 4,854,232 | A | * | 8/1989 | Oda | 101/211 |
| 5,469,787 | A | | 11/1995 | Turner et al. | |
| 6,101,939 | A | * | 8/2000 | Giori et al. | 101/177 |

FOREIGN PATENT DOCUMENTS

| | | |
|---|---|---|
| DE | 195 23 378 | 1/1997 |
| DE | 197 20 746 | 11/1998 |
| WO | WO 99/32292 | 7/1999 |

* cited by examiner

*Primary Examiner*—Hai Pham
*Assistant Examiner*—Manish S. Shah
(74) *Attorney, Agent, or Firm*—Jones Tullar & Cooper, PC

(57) ABSTRACT

Multicolor prints are produced on a sheet in a printing machine. More than four colors can be applied to the sheet during its passage through the printing machine. Three printing units and an application unit are associated either directly with a printing cylinder of the printing machine or with a transfer drum which is associated with the printing cylinder. Seven colors, or six colors and a varnish coating can be applied to the sheet by the printing machine.

21 Claims, 3 Drawing Sheets

METHOD AND DEVICE FOR PRODUCING A MULTICOLOR PRINT

FIELD OF THE INVENTION

The present invention relates to a method and to a device for producing a multicolor print on a sheet in printing presses. The sheet rests on the printing cylinder, for more than one revolution of the printing cylinder, is held by a gripper connection on the printing cylinder and is sequentially printed in several colors.

DESCRIPTION OF THE PRIOR ART

A printing press is known from U.S. Pat. No. 5,496,787 which has a sheet feeder, along with a sheet feeding stack, elements for conveying a sheet to be imprinted to a feed line, and feed mechanisms for conveying sheets from the feed line to a printing cylinder having three print saddles. The former works together with at least one cylinder group, consisting of an offset cylinder with two operative areas, and a printing forme cylinder, also with two operative areas, and a delivery device containing delivery chains.

Two revolutions of the printing cylinder are required for producing a multicolor print. In this case, a sheet is fed only to every second print saddle. Moreover, a printed sheet is removed only from every second print saddle.

Following the application of the last color, the printed sheet is passed on to a chain conveyor and is deposited on a delivery stack.

This printing press has a limitation that, because of its construction, there are no chances for providing the sheet with a larger color effect by the application of additional colors.

DE 195 23 378 A1 has become known recently, and which discloses a printing press operating in accordance with the same principle as the printing press in U.S. Pat. No. 5,496,787. In accordance with the subject of DE 195 23 378 A1, a laser illustrating arrangement is provided for illustrating the printing plates in the press.

Better color prints, by means of the application of more than four colors, cannot be achieved with this printing press either.

SUMMARY OF THE INVENTION

It is the object of the present invention to provide a printing press in such a way that more than four colors can be applied to the sheet in the course of one passage through the press.

In accordance with the invention, this object is attained by the utilization of a printing cylinder that receives and holds the sheets to be printed for more than one revolution. Several printing units are directly associated with the printing cylinder. At least one transfer drum is also associated with the printing cylinder. An additional printing unit is also associated with the printing cylinder or with the transfer drum.

The present invention makes it advantageously possible to increase the range of employment of a printing press with a triple-size printing cylinder and doublesize offset and printing forme cylinders in that a first and a second transfer drum are arranged downstream of the printing cylinder, and the first transfer drum is provided with a rubber blanket. In this way, the first transfer drum can be used as an image transfer device, and a third printing unit for applying further colors to the sheet can be installed in the printing press.

It is not important whether the first transfer drum receives the print image directly from a printing forme cylinder or indirectly from an offset cylinder. It is essential that the transfer drum is equipped in such a way that it can perform several functions such as sheet conveyance, image conveyance and image transfer. The attainment of the object of the present invention requires only a small outlay, because it is integrated in a printing press which can print in four colors on a sheet during one passage.

Moreover, the arrangement of an application device for use with the second transfer drum for varnishing or for the application of an additional color to the sheet, increases the range of employment of the printing press.

BRIEF DESCRIPTION OF THE DRAWINGS

The present invention will be described in greater detail in what follows by means of a preferred embodiment embodiment.

Shown in the drawings are in.

DESCRIPTION OF THE PREFERRED EMBODIMENT

Figure 1:
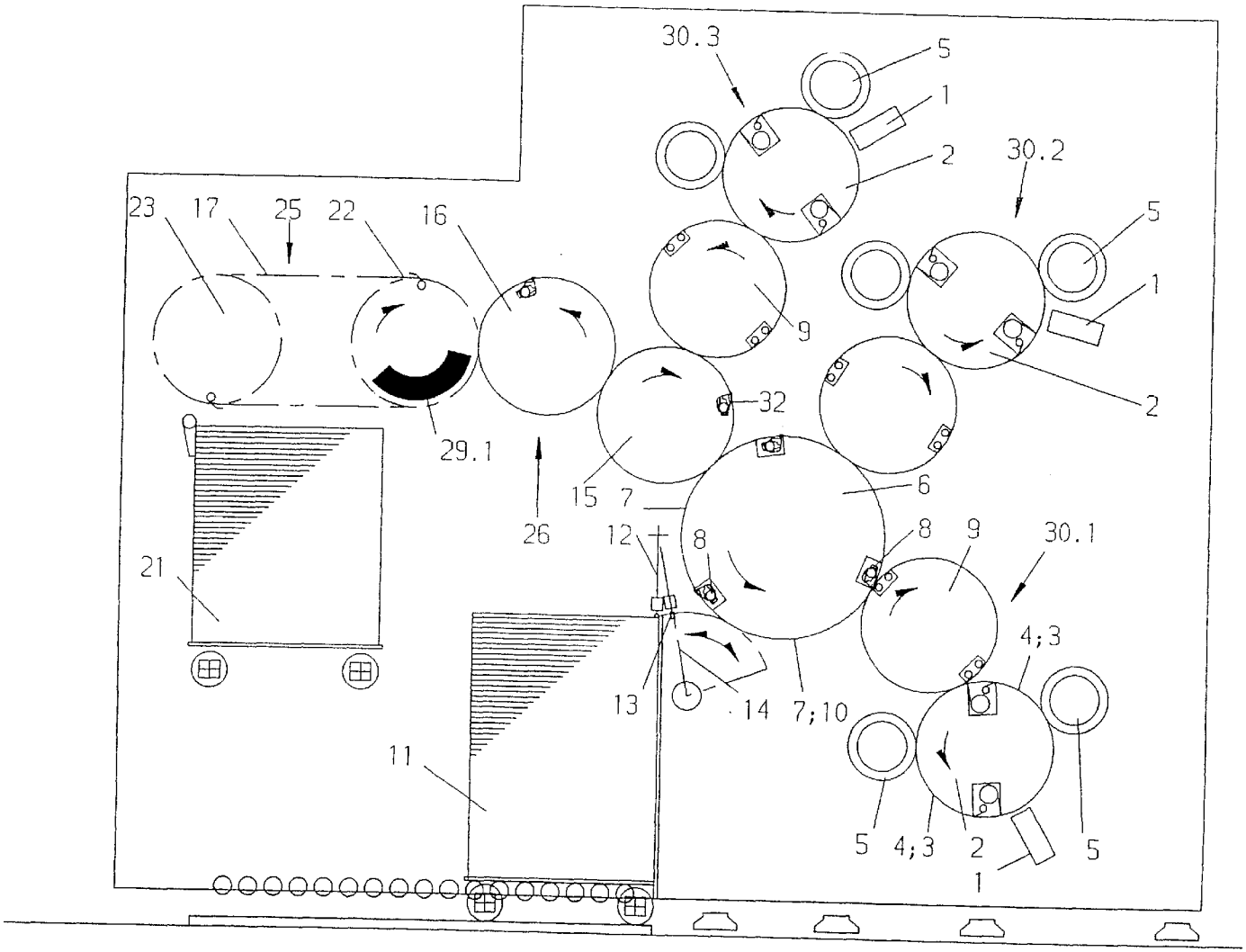
FIG. 1: a schematic representation of a printing press in accordance with the present invention in a lateral view.
Figure 2:
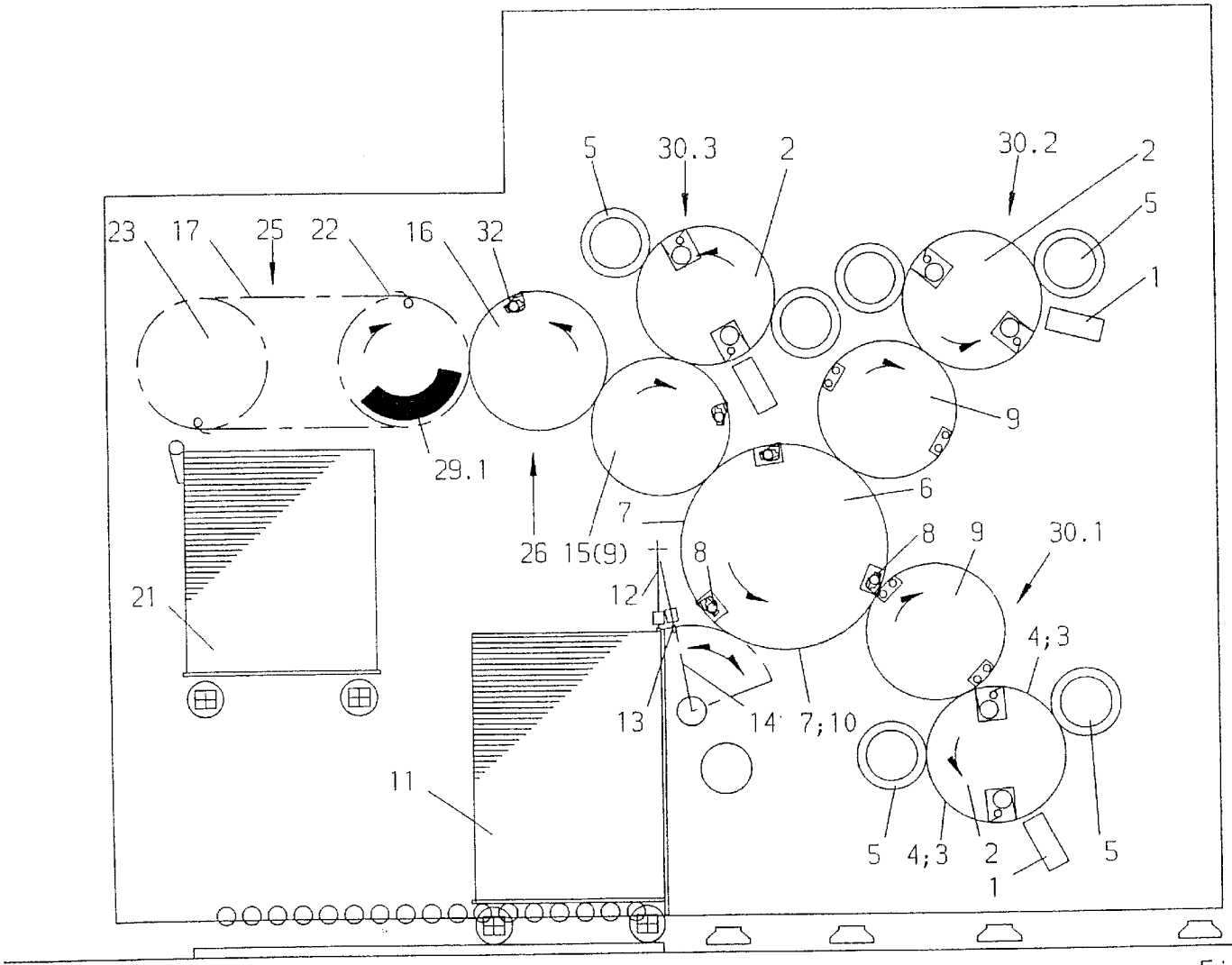
FIG. 2: A schematic representation similar to FIG. 1 with the utilization of the first transfer drum as an offset cylinder of the third printing unit, and in FIG. 3: a printing press in accordance with FIG. 1 with an additional application device cooperating, with the second transfer drum for the application of color or varnish.
Figure 3:
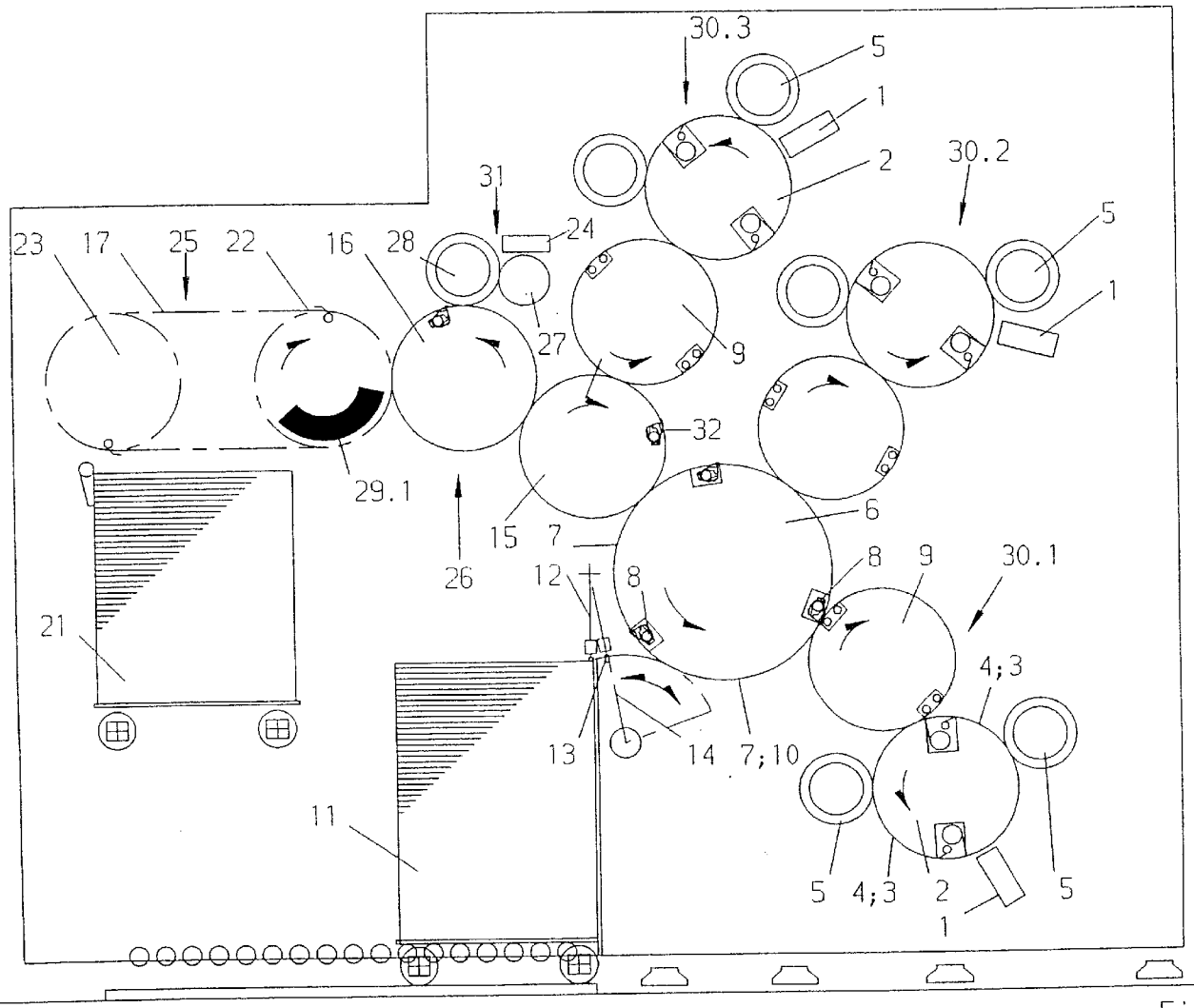

The printing press of the present invention, in accordance with FIGS. 1 to 3, is constructed as follows. A device 1 for inscribing printing formes 3 clamped on a printing forme cylinder 2 of a first printing formation or unit 30.1 is provided. The printing forme cylinder 2 is equipped with two operative surfaces 4, each of which supports a printing forme 3. Furthermore, two ink units 5, which can be alternatingly put into and out of contact with the printing forme cylinder 2, are assigned to the latter.

The printing forme cylinder 2 is in operative connection with a printing cylinder 6 via an offset cylinder 9 with two surfaces.

The printing cylinder 6 has three printing surfaces 7 and accordingly three gripper rows 8 for grasping the sheets 10 to be imprinted. A second printing formation or unit 30.2 consisting of an offset cylinder 9, a printing forme cylinder 2, an ink unit 5 and a device 1 for inscribing is also associated with the printing cylinder 6.

The printing cylinder 6, as depicted, has a triple-size diameter. The printing forme cylinder 2 and the offset cylinders 9 each have a double-size diameter. The offset cylinder 9, the printing forme cylinder 2 and the two ink units 5 each constitute a printing formation or unit 30.1 to 30.3, wherein, in accordance with FIG. 1 and FIG. 3, the first and second printing units 30.1, 30.2 are directly assigned to the printing cylinder 6.

For conveying the sheets 10 to be printed from a sheet feeding stack 11 to a feed line 13, elements 12 for conveyance are arranged above the sheet feeding stack 11. A feed mechanism 14 is provided for conveying the sheets 10 to be printed from the feed line 13 to the printing cylinder 6.

For removing the sheets from the printing press, a sheet removal device 26 is arranged downstream of the printing cylinder 6 and consists of first and second transfer drums 15, 16 and a sheet delivery device 25.

The sheet delivery device 25 consists of a delivery chain circuit 17, conducted around front and the rear chain reversing wheels 22, 23, and of a sheet delivery stack 21 arranged underneath the delivery chain circuit 17.

The first and second, as viewed in the conveying direction of the sheet 10, transfer drums 15, 16 are each provided with a gripper system 32 for sheet conveying. The diameters of the first and second transfer drums 15, 16 correspond to the diameters of the printing forme cylinder 2 and the offset cylinder 9.

The first transfer drum 15 has a continuous surface in the first functional area, which surface is covered with a rubber blanket. The printing cylinder 6 and the first transfer drum 15 have a common tangent point $t_{6,15}$.

The third printing unit 30.3, which has the same structure including an offset cylinder 9, a printing forme cylinder 2, and two ink units 5 as the first and second printing units 30.1, 30.2, is assigned to the first transfer drum 15, as seen in FIG. 1 and in FIG. 3.

The two ink units 5 for each printing unit 30.1 to 30.3 operate alternatingly by making alternating contact with the associated printing forme cylinder 2, so that two colors for printing unit 30.1 to 30.3 can be applied to the sheets 10 carried by the printing cylinder.

These two colors applied by each printing unit are the first and fourth color applied by the first printing unit 30.1, the second and fifth color applied by the second printing unit 30.2, and the third and sixth color applied by the third printing unit 30.3. The third printing unit 30.3 is, as seen in FIGS. 1 and 3 associated with the printing cylinder 6 through the first transfer drum 15 which performs the functions of sheet conveyance, image conveyance and image transfer in this arrangement.

In accordance with the embodiment represented in FIG. 2, the first transfer drum 15 takes over the function of the third printing unit 30.3. Because of this, the actual offset cylinder 9 is omitted, and the third printing unit 30.3 is directly assigned to the printing cylinder 6, the same as the other printing units 30.1, 30.2.

In accordance with another embodiment, which is shown in Fig. 3, the second transfer drum 16 is provided with a closed drum cap, which is embodied so solidly that the second transfer drum 16 can perform the function of a counter-pressure cylinder.

An application device 31 for applying varnish or applying another color to the sheet 10 is assigned to the second transfer drum 16, as shown in FIG. 3. The application device 31 consists of an ink duct 24, a screen roller 27 and an application roller 28, which is provided between the screen roller 27 and the second transfer drum 16. The diameters of the second transfer drum 16, the application roller 28 and screen roller 27 have a ratio of 2 to 1 to 0.5, respectively.

When the application device 31 is to be used for varnishing, the ink duct 24 is filled with varnish and the application roller 28 is provided with a rubber blanket. When the application device 31 is to be used for printing by the application of a further color, the ink duct 24 is filled with ink and the application roller 28 is provided with a flexographic printing plate.

A dryer 29.1 can be provided in the front chain reversing wheel 22 for drying the printed sheets 10.

The function of the printing press in accordance with a first embodiment of the present invention is depicted as follows, and as shown in FIG. 1:

A sheet 10, which is separated from the sheet feeding stack 11, is conveyed by the elements 12 for conveyance as far as the feed line 13 of the printing press and is transferred to a gripper unit 8 of the printing cylinder 6 by the feed mechanism 14. In this process, a new sheet 10 is supplied to only each second gripper row 8 passing by the feed mechanism 14.

A separate print image is applied by the forme inscribing device 1 to each of the printing formes 3 clamped on the printing forme cylinder 2. Each print image is inked by the associated one of the two ink units 5 and is transferred to the offset cylinder 9, which then passes on the print image to the sheet 10 lying on the printing cylinder 6. The first and second colors are applied to the sheet 10 by the first and second printing units 30.1, 30.2. A third print image is simultaneously transferred to the offset cylinder 9 of the third printing unit 30.3 which is assigned to the first transfer drum 15. Now the third print image is transferred from the rubber blanket of the offset cylinder 9 to the rubber blanket of the first transfer drum 15, and at the tangent point $t_{6,15}$ as a third color from the first transfer drum 15 to the sheet 10, which sheet 10 is still held by the gripper row 8 of the printing cylinder 6.

Thereafter, the sheet 10, secured on the printing cylinder 6, is again turned through a second entire revolution around the printing cylinder 6, so that the fourth and fifth colors can be applied by the first and second printing units 30.1, 30.2.

Once the front edge of the sheet reaches the tangent point $t_6$, 15 between the printing cylinder 6 and the first transfer drum 15, the sheet 10, which has now been provided with five color applications, is transferred from the printing cylinder 6 to the gripper system 32 of the first transfer drum 15. Simultaneously, the sixth color, provided by the third printing unit 30.3 is transferred from the rubber blanket of the first transfer drum 15 to the sheet 10 while the sheet 10 is still supported on the printing cylinder 6. The application of the sixth color to the sheet 10 takes place at the tangent point $t_{6,15}$.

Thereafter, the sheet 10 is conveyed from the first transfer drum 15 to the second transfer drum 16 and then, via the second transfer drum 16, to the delivery chain circuit 17 and is deposited on the sheet delivery stack 21.

With the second embodiment in accordance with FIG. 2, the process steps are performed generally as above, but with the following change. Because the first transfer drum 15 has now taken on the function of the third offset cylinder 9, the third and sixth colors are transferred from the printing forme cylinder 2 of the third printing unit 30.3 directly to the first transfer drum 15, and from there to the sheet 10, which again is selectively conducted by a gripper row 8 of the printing cylinder 6 or from the gripper system 32 of the first transfer drum 15.

Thereafter, the sheet 10 is deposited on the sheet delivery stack 21, as discussed previously.

If the application device 31 is assigned to the second transfer drum 16, in accordance with the third embodiment, as represented in FIG. 3, the sheet 10 can be additionally provided with a varnish coat or with a further color, and thereafter will be deposited on the sheet delivery stack 21.

While preferred embodiments of a method and a device for producing a multicolor print in accordance with the present invention have been set forth fully and completely hereinabove, it will be apparent to one of skill in the art that a number of changes in, for example the drive for the printing cylinder, the drives for the chain conveyors, and the like can be made without departing from the true spirit and scope of the present invention which is accordingly to be limited only by the following claims.

What is claimed is:

1. A method for producing a multicolor print on a sheet in a rotary printing press including:

providing a printing cylinder having a plurality of sheet receiving surfaces;

securing a sheet to said printing cylinder and rotating said cylinder with said sheet for more than one revolution;

providing first and second multiple color printing units associated directly with said printing cylinder;

providing a third multiple color printing unit having a first transfer drum unit associated with said printing cylinder;

applying first and second colors to said sheet from said first and second printing units during a first rotation of said printing cylinder;

applying a third color from said first transfer drum to said sheet during said first rotation of said printing cylinder;

applying fourth and fifth colors to said sheet from said first and second printing units during a second rotation of said printing cylinder;

applying a sixth color to said first transfer drum from said third printing unit;

applying said sixth color to said sheet from said first transfer drum;

transferring said sheet from said printing cylinder to said first transfer drum; and depositing said printed sheet on a sheet delivery stack.

2. A method for providing a multicolor print on a sheet in a rotary printing press including:

providing a printing cylinder having a plurality of sheet receiving surfaces;

securing a sheet to said printing cylinder and rotating said cylinder with said sheet for more than one revolution;

providing first and second multiple color printing units associated with said printing cylinder;

providing a third multiple color printing unit associated with said printing cylinder and with a first transfer cylinder;

applying first second and third colors to said sheet from said first second and third printing units during a first rotation of said printing cylinder;

applying fourth and fifth colors to said sheet from said first and second printing units during a second rotation of said printing cylinder;

transferring said sheet from said printing cylinders to said first transfer cylinder;

applying a sixth color to said sheet on said first transfer cylinder from said third printing unit; and depositing said printed sheet on a sheet delivery stack.

3. The method of claim 1 further including providing an application device and applying an additional color on said sheet.

4. The method of claim 2 further including providing an application device and applying an additional color on said sheet.

5. The method of claim 1 further including providing an application device and finishing said printed sheet with varnish form said application device.

6. The method of claim 2 further including providing an application device and finishing said printed sheet with varnish from said application device.

7. A device usable to provide a multicolor print on a sheet in a printing press comprising:

a printing cylinder having sheet grippers, said printing cylinder being adapted to retain a sheet to be printed for more than one revolution of said printing cylinder;

three sheet receiving operative surfaces on said printing cylinder which has a triple-size diameter;

first and second identical printing units each assigned directly to said printing cylinder;

first and second transfer drums arranged sequentially in a direction of sheet transport downstream of said printing cylinder; and a third printing unit associated with said first transfer drum.

8. A device usable to produce a multicolor print on a sheet in a printing press comprising:

a printing cylinder having sheet grippers, said printing cylinder being adapted to retain a sheet to be printed for more than one revolution of said printing cylinder;

three sheet receiving operative surfaces on said printing cylinder which has a triple-size diameter;

first and second sheet transfer drums arranged sequentially in a direction of sheet transport downstream of said printing cylinder; and first, second, and third printing units each assigned to said printing cylinder, said third printing unit contacting said first sheet transfer drum.

9. The device of claim 7 wherein each of said printing units includes a double-size offset cylinder, a printing forme cylinder, and first and second ink units associated with each said printing forme cylinder.

10. The device of claim 8 wherein each of said printing units includes a double-size offset cylinder, a printing forme cylinder, and first and second ink units associated with each said printing forme cylinder.

11. The device of claim 7 wherein said first transfer drum accomplishes sheet and image conveying and image transfer.

12. The device of claim 8 wherein said first transfer drum accomplishes sheet and image conveying and image transfer.

13. The device of claim 7 wherein said first transfer device is provided with a rubber blanket.

14. The device of claim 8 wherein said first transfer device is provided with a rubber blanket.

15. The device of claim 8 wherein said first transfer drum is an offset cylinder.

16. The device of claim 7 further including an application device associated with said second transfer drum.

17. The device of claim 8 further including an application device associated with said second transfer drum.

18. The device of claim 16 wherein said application device can selectively apply varnish and ink to said sheet.

19. The device of claim 17 wherein said application device can selectively apply varnish and ink to said sheet.

20. The device of claim 7 wherein said first and second transfer drums include sheet gripper systems.

21. The device of claim 8 wherein said first and second transfer drums include sheet gripper systems.

* * * * *